US010140907B2

(12) United States Patent
Lin

(10) Patent No.: US 10,140,907 B2
(45) Date of Patent: Nov. 27, 2018

(54) DISPLAY PANEL, DISPLAY DEVICE AND METHOD FOR PIXEL ARRANGEMENT

(71) Applicant: BOE TECHNOLOGY GROUP CO., LTD., Beijing (CN)

(72) Inventor: Junjie Lin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/505,513

(22) PCT Filed: Jun. 12, 2016

(86) PCT No.: PCT/CN2016/085415
§ 371 (c)(1),
(2) Date: Feb. 21, 2017

(87) PCT Pub. No.: WO2017/113623
PCT Pub. Date: Jul. 6, 2017

(65) Prior Publication Data

US 2017/0345353 A1 Nov. 30, 2017

(30) Foreign Application Priority Data

Dec. 31, 2015 (CN) ..... 2015 1 1028542

(51) Int. Cl.
*G09G 3/20* (2006.01)

(52) U.S. Cl.
CPC ..... *G09G 3/2003* (2013.01); *G09G 3/2074* (2013.01); *G09G 2300/0452* (2013.01);
(Continued)

(58) Field of Classification Search
None
See application file for complete search history.

(56) References Cited

U.S. PATENT DOCUMENTS 6,714,206 B1 * 3/2004 Martin ..... G09G 3/2003 345/589
7,046,256 B2 5/2006 Credelle
(Continued)

FOREIGN PATENT DOCUMENTS

CN 101325027 A 12/2008
CN 102903318 A 1/2013
(Continued)

OTHER PUBLICATIONS

Chinese Office Action in Chinese Application No. 201511028542.0 dated Nov. 3, 2017 with English translation.
(Continued)

*Primary Examiner* — Kumar Patel
*Assistant Examiner* — Amy C Onyekaba
(74) *Attorney, Agent, or Firm* — Collard & Roe, P.C.

(57) ABSTRACT

A display panel, a display device and a method for pixel arrangement, which can improve picture quality. The display panel includes a plurality of sub-pixels arranged in an array, and the sub-pixels arranged in a first direction are arranged in one of following modes: a first mode of sub-pixel arrangement, in which a first sub-pixel or a third sub-pixel is inserted between every two second sub-pixels; and a second mode of sub-pixel arrangement, in which the first sub-pixel and the third sub-pixel are inserted between every two second sub-pixels.

5 Claims, 7 Drawing Sheets

(52) U.S. Cl.
CPC ..... *G09G 2320/0233* (2013.01); *G09G 2320/0666* (2013.01); *G09G 2320/0673* (2013.01)

(56) References Cited

U.S. PATENT DOCUMENTS

| | | | | |
|---|---|---|---|---|
| 8,134,583 | B2 | 3/2012 | Credelle | |
| 8,786,645 | B2 | 7/2014 | Gu | |
| 9,767,742 | B2 * | 9/2017 | Nakagawa | G09G 3/3607 |
| 2005/0083246 | A1 * | 4/2005 | Saishu | H04N 13/0404 345/1.1 |
| 2006/0221030 | A1 * | 10/2006 | Shih | G09G 3/3611 345/88 |
| 2013/0027437 | A1 * | 1/2013 | Gu | G09G 3/3607 345/690 |
| 2013/0106891 | A1 | 5/2013 | Matsueda et al. | |
| 2013/0148019 | A1 | 6/2013 | Wu et al. | |
| 2015/0015466 | A1 * | 1/2015 | Feng | G09G 3/2003 345/77 |
| 2015/0253476 | A1 * | 9/2015 | Shao | G02B 5/201 359/891 |
| 2016/0204094 | A1 * | 7/2016 | Yang | H01L 27/124 257/773 |
| 2016/0284769 | A1 * | 9/2016 | Chien | H01L 27/3216 |

FOREIGN PATENT DOCUMENTS

| | | | |
|---|---|---|---|
| CN | 103366683 | A | 10/2013 |
| CN | 103529588 | A | 1/2014 |
| CN | 104280938 | A | 1/2015 |
| CN | 105044954 | A | 11/2015 |
| CN | 105096755 | A | 11/2015 |
| CN | 105096806 | A | 11/2015 |
| CN | 204903911 | U | 12/2015 |
| CN | 204904733 | U | 12/2015 |
| CN | 105575313 | A | 5/2016 |

OTHER PUBLICATIONS

International Search Report of PCT/CN2016/085415 in Chinese, dated Sep. 21, 2016 with English translation.
Notice of Transmittal of the International Search Report of PCT/CN2016/085415 in Chinese, dated Sep. 21, 2016.
Written Opinion of the International Searching Authority of PCT/CN2016/085415 in Chinese, dated Sep. 21, 2016 with English translation.
Second Chinese Office Action in Chinese Application No. 201511028542.0 dated Jul. 19, 2018 with English translation.

* cited by examiner

| | | | | | | | | | |
|---|---|---|---|---|---|---|---|---|---|
| B | A or C | B | A or C | B | A or C | B | A or C | B | …… |

FIG. 1(a)

| | | | | | | | | | |
|---|---|---|---|---|---|---|---|---|---|
| B | A and C | B | A and C | B | A and C | B | A and C | B | …… |

FIG. 1(b)

| | | | | | | | | | | | | |
|---|---|---|---|---|---|---|---|---|---|---|---|---|
| B | A | B | C | B | A | B | C | B | A | B | C | … |

FIG. 2(a)

| | | | | | | | | | | | | |
|---|---|---|---|---|---|---|---|---|---|---|---|---|
| B | C | B | A | B | C | B | A | B | C | B | A | … |

FIG. 2(b)

| | | | | | | | | | | | | |
|---|---|---|---|---|---|---|---|---|---|---|---|---|
| B | A | B | A | B | A | B | A | B | A | B | A | … |

FIG. 2(c)

| | | | | | | | | | | | | |
|---|---|---|---|---|---|---|---|---|---|---|---|---|
| B | C | B | C | B | C | B | C | B | C | B | C | … |

FIG. 2(d)

| | | |
|---|---|---|
| B | A | C |

| | | |
|---|---|---|
| B | C | A |

FIG. 3

| | | | | | |
|---|---|---|---|---|---|
| m% | m% | m% | m% | m% | m% |
| 100% | m% | n% | n% | m% | 100% |
| m% | m% | m% | m% | m% | m% |
| m% | m% | m% | m% | m% | m% |
| n% | m% | 100% | 100% | m% | n% |
| m% | m% | m% | m% | m% | m% |

FIG. 6

| | | | | | |
|---|---|---|---|---|---|
| m% | m% | m% | m% | m% | m% |
| n% | m% | 100% | 100% | m% | n% |
| m% | m% | m% | m% | m% | m% |
| m% | m% | m% | m% | m% | m% |
| 100% | m% | n% | n% | m% | 100% |
| m% | m% | m% | m% | m% | m% |

FIG. 7

DISPLAY PANEL, DISPLAY DEVICE AND METHOD FOR PIXEL ARRANGEMENT

CROSS REFERENCE TO RELATED APPLICATIONS

This application is the National Stage of PCT/CN2016/085415 filed on Jun. 12, 2016, which claims priority under 35 U.S.C. § 119 of Chinese Application No. 201511028542.0 filed on Dec. 31, 2015, the disclosure of which is incorporated by reference.

TECHNICAL FIELD

Embodiments of the present disclosure relate to a display panel, a display device and a method for pixel arrangement.

BACKGROUND

Generally, in existing display technologies, each pixel is divided into three sub-pixels (e.g., a red sub-pixel, a green sub-pixel and a blue sub-pixel) or four sub-pixels (e.g., a red sub-pixel, a green sub-pixel, a blue sub-pixel and a white sub-pixel), and in each direction of a display there should be sub-pixels of three primary colors (red, green and blue) with the numbers of the sub-pixels of respective primary colors being equal to each other. During display individual sub-pixels emit light rays of different colors that are mixed to produce light of any color as required.

However, as increasingly high picture quality is required by consumers, there is a need for a display technology that can reduce color fringing.

SUMMARY

Embodiments of the present disclosure provide a display panel, a display device and a method for pixel arrangement that can improve picture quality.

According to an embodiment of the present disclosure, there is provided display panel comprising a plurality of sub-pixels arranged in an array, wherein the sub-pixels arranged in a first direction are arranged in one of following modes: a first mode of sub-pixel arrangement, in which a first sub-pixel or a third sub-pixel is inserted between every two second sub-pixels; and a second mode of sub-pixel arrangement, in which the first sub-pixel and the third sub-pixel are inserted between every two second sub-pixels.

In an example, in the second mode of sub-pixel arrangement, sub-pixels are arranged in at least one of a sequence of the second sub-pixel, the first sub-pixel and the third sub-pixel and a sequence of the second sub-pixel, the third sub-pixel and the first sub-pixel.

In an example, the first mode of sub-pixel arrangement and the second mode of sub-pixel arrangement are deployed alternately in a second direction.

In an example, the first direction is one of a row direction and a column direction while the second direction is the other of the row direction and the column direction.

In an example, the second sub-pixel is a green sub-pixel, the first sub-pixel is one of a red sub-pixel and a blue sub-pixel, and the third sub-pixel is the other of the red sub-pixel and the blue sub-pixel.

In an example, compensation is performed on image data for the first sub-pixel using a first compensation parameter and mapping is performed on a compensation result of the image data for the first sub-pixel using a first mapping parameter to obtain output image data for the first sub-pixel.

In an example, compensation is performed on image data for the third sub-pixel using a third parameter and mapping is performed on a compensation result of the image data for the third sub-pixel using a third mapping parameter to obtain output image data for the third sub-pixel.

In an example, mapping is performed on image data for the second sub-pixel using a second mapping parameter, and a mapping result of the image data for the second sub-pixel, the compensation result of the image data for the first sub-pixel and the compensation result of the image data for the third sub-pixel are superimposed onto each other to obtain output image data for the second sub-pixel.

According to another embodiment of the present disclosure, there is provided a display device, comprising any of the display panels.

According to another embodiment of the present disclosure, there is provided a method for sub-pixel arrangement, comprising: inserting a first sub-pixel or a third sub-pixel between every two second sub-pixels; or inserting the first sub-pixel and the third sub-pixel between every two second sub-pixels.

In an example, inserting the first sub-pixel and the third sub-pixel between every two second sub-pixels includes: arranging sub-pixels in at least one of a sequence of the second sub-pixel, the first sub-pixel and the third sub-pixel and a sequence of the second sub-pixel, the third sub-pixel and the first sub-pixel.

In an example, a first mode of sub-pixel arrangement and a second mode of sub-pixel arrangement are deployed alternately in a second direction.

In an example, a first direction is one of a row direction and a column direction while the second direction is the other of the row direction and the column direction.

In an example, the second sub-pixel is a green sub-pixel, the first sub-pixel is one of a red sub-pixel and a blue sub-pixel, and the third sub-pixel is the other of the red sub-pixel and the blue sub-pixel.

Therefore, according to embodiments of the present disclosure, sub-pixels on the display panel are arranged according to the first or second mode of sub-pixel arrangement so as to improve picture quality.

BRIEF DESCRIPTION OF DRAWINGS

The present disclosure will be readily understood from the following detailed description with the aid of accompanying figures, in which the same number refers to elements of the same structure and in which:

FIG. 1(*a*) is a schematic diagram illustrating a first mode of sub-pixel arrangement and FIG. 1(*b*) is a schematic diagram illustrating a second mode of sub-pixel arrangement;

FIGS. 2(*a*)-2(*d*) show a few examples of the first mode of sub-pixel arrangement;

FIG. 3 illustrates two unit blocks of pattern of the second mode of sub-pixel arrangement;

FIG. 6 is a schematic diagram illustrating the compensation effects by a first compensation unit in the case of the sub-pixel arrangement as illustrated in FIG. 4 according to an embodiment of the present disclosure;

FIG. 7 is a schematic diagram illustrating the compensation effects by a second compensation unit in the case of the sub-pixel arrangement as illustrated in FIG. 4 according to an embodiment of the present disclosure;

DETAILED DESCRIPTION OF EMBODIMENTS

Figure 4:
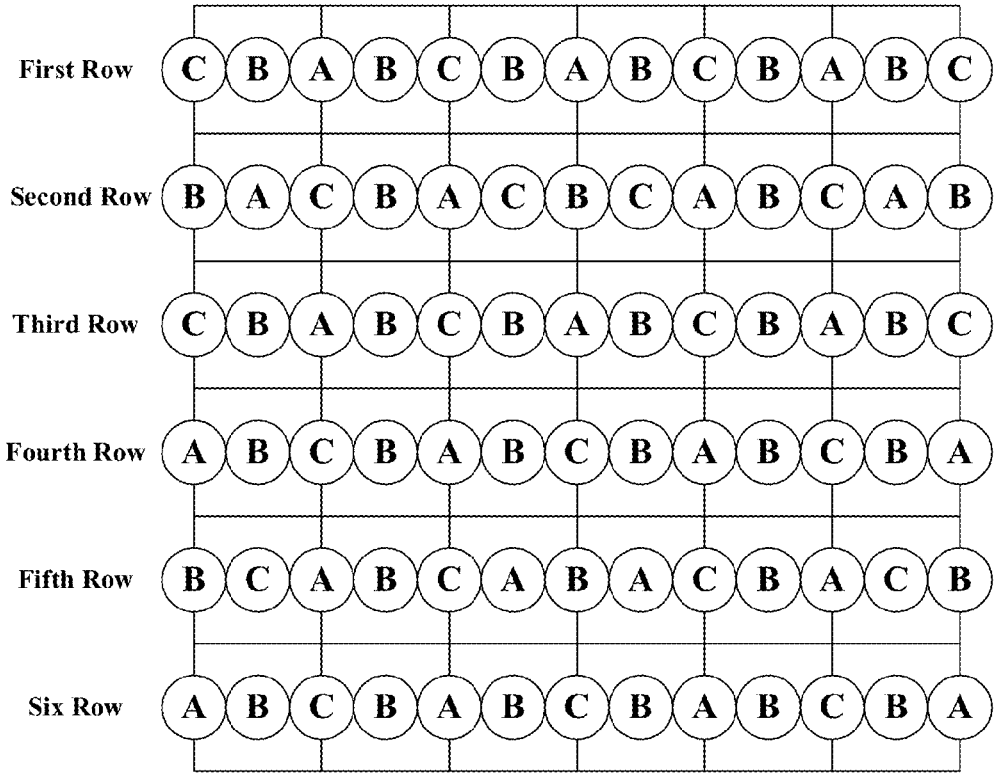
FIG. 4 shows an example of the sub-pixel arrangement according to an embodiment of the present disclosure.

The technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Hereafter, description will proceed in the case that each pixel on a display panel is divided into three sub-pixels, i.e., each pixel includes a first sub-pixel, a second sub-pixel and a third sub-pixel. However, the present disclosure is not limited to this case. It can be understood by those of ordinary skills in the art that, with suitable adaptation, embodiments of the present disclosure may be applied to arrangement of pixels divided in other ways.

It should be understood that the terms "first", "second", "third" etc. are used herein to describe various elements, assemblies, areas, layers and/or parts, but the elements, assemblies, areas, layers and/or parts should not be limited by them. Those terms are only used to distinguish one element, assembly, area, layer and/or part from another element, assembly, area, layer and/or part. Therefore, a first element, assembly, area, layer and/or part referenced in the following discussion may be referred to as a second element, assembly, area, layer and/or part without departing from the teaching of the present disclosure.

An embodiment of the present disclosure provides a display panel including a plurality of sub-pixels arranged in an array; the sub-pixels arranged in a first direction are arranged in one of the following modes: a first mode of sub-pixel arrangement, in which a first or third sub-pixel is inserted between every two second sub-pixels, and a second mode of sub-pixel arrangement, in which a first and a third sub-pixels are inserted between every two second sub-pixels.

Therefore, in the display panel according to the embodiment of the present disclosure, sub-pixels on the display panel are arranged in the first or second mode of sub-pixel arrangement so as to improve picture quality.

FIG. 1(*a*) is a schematic diagram illustrating the first mode of sub-pixel arrangement, and FIG. 1(*b*) is a schematic diagram illustrating the second mode of sub-pixel arrangement.

Hereafter, for simplicity of description, a first sub-pixel is indicated by a sub-pixel A, a second sub-pixel is indicated by a sub-pixel B, and a third sub-pixel is indicated by a sub-pixel C.

FIGS. 2(*a*)-2(*d*) show a few examples of the first mode of sub-pixel arrangement. With reference to FIGS. 2(*a*) to 2(*d*), it can be seen that when a sub-pixel A or a sub-pixel C is inserted between every two sub-pixels B, arrangement may be performed in one of the following patterns.

(1) Sub-pixels A and C are inserted alternately in this order, i.e., sub-pixels are arranged in the sequence "BABCBABCBABC . . . " (as illustrated in FIG. 2(*a*));

(2) Sub-pixels C and A are inserted alternately in this order, i.e., sub-pixels are arranged in the sequence "BCBABCBABCBA . . . " (as illustrated in FIG. 2(*b*));

(3) Only a sub-pixel A is inserted, i.e., sub-pixels are arranged in the sequence "BABABABABABA . . . " (as illustrated in FIG. 2(*c*)); and (4) Only a sub-pixel C is inserted, i.e., sub-pixels are arranged in the sequence "BCBCBCBCBCBC . . . " (as illustrated in FIG. 2(*d*)).

With respect to the first mode of sub-pixel arrangement, the four patterns described above may be applied separately or in combination, for example, when the first mode of sub-pixel arrangement is deployed in a predetermined direction, the pattern at the edge of the display panel may be different from that at the center of the display panel, so that better display effects may be achieved. For example, arrangement may be performed in the pattern "BABABABC . . . BABCBABA".

Furthermore, although the first mode of sub-pixel arrangement is described as inserting a first sub-pixel or a third sub-pixel between every two second sub-pixels, embodiments of the present disclosure are not limited to the case of taking a second sub-pixel as the starting sub-pixel, and, as can be understood by those of ordinary skills in the art, a first sub-pixel or a third sub-pixel may be used as the starting sub-pixel, that is, the arrangement patterns "ABCBABCBABCB . . . ", "CBABCBABCBAB . . . ", "ABABABABABAB . . . ", "CBCBCBCBCBCB . . . " and the like may occur as well.

At this point, for simplicity of description, patterns resulting from combination will not be enumerated and arrangement can be performed flexibly by those of ordinary skills in the art according to design requirements.

FIG. 3 illustrates two unit blocks of pattern of the second mode of sub-pixel arrangement.

In the second mode of sub-pixel arrangement, sub-pixels may be arranged in at least one of the sequence "a second sub-pixel, a first sub-pixel and a third sub-pixel" and the sequence "a second sub-pixel, a third sub-pixel and a first sub-pixel".

With reference to FIG. 3, sub-pixels may be arranged according to the unit block of pattern "BAC" or "BCA".

For example, according to the second mode of sub-pixel arrangement, sub-pixels may be arranged in one of the following patterns along one and the same direction.

(1) Arrangement is performed in a pattern with cycling unit blocks of pattern "BAC", i.e., in the pattern "BAC-BACBAC . . . ";

(2) Arrangement is performed in a pattern repeating the unit block of pattern "BCA", i.e., in the pattern "BCAB-CABCA . . . "; or (3) Arrangement is performed in a pattern resulted from any combination of the two unit blocks of pattern "BAC" and "BCA".

In one embodiment, the first mode of sub-pixel arrangement and the second mode of sub-pixel arrangement may be deployed alternately along a second direction.

In one embodiment, the first and second modes of sub-pixel arrangement may be deployed alternately row by row or column by column.

In another embodiment, a first plurality of rows or columns of sub-pixels may be arranged in the first mode of sub-pixel arrangement and then a second plurality of rows or columns of sub-pixels may be arranged in the second mode of sub-pixel arrangement; the first plurality of rows or columns may be the same as or different from the second plurality of rows or columns in number.

However, embodiments of the present disclosure are not limited to this, the first and second modes of sub-pixel arrangement may be deployed alternately in any manner.

According to the embodiment of the present disclosure, the first direction is one of the row direction and the column direction while the second direction is the other of the two directions.

The individual rows or columns of sub-pixels arranged in the first mode of sub-pixel arrangement may have patterns the same as or different from each other.

The individual rows or columns of sub-pixels arranged in the second mode of sub-pixel arrangement may have patterns the same as or different from each other.

Therefore, according to the embodiment of the present disclosure, the modes of sub-pixel arrangement can be deployed flexibly according to actual demands and design requirements.

In one embodiment, the first pixel is one of a red sub-pixel and a blue sub-pixel, the second pixel is a green sub-pixel, and the third pixel is the other one of the red sub-pixel and the blue sub-pixel.

FIG. 4 shows an example of the sub-pixel arrangement according to an embodiment of the present disclosure. It can be understood by those of ordinary skills in the art that the example illustrated in FIG. 4 only shows some of the sub-pixels arranged on the display panel.

As illustrated in FIG. 4, the first row of sub-pixels are arranged in the pattern "ABCBABCBABCB . . . " of the first mode of sub-pixel arrangement, the second row of sub-pixels are arranged in a pattern resulted from any combination of the unit blocks of pattern "BAC" and "BCA" of the second mode of sub-pixel arrangement, the third row of sub-pixels are still arranged in the pattern "ABCBAB-CBABCB . . . " of the first mode of sub-pixel arrangement, the four row of sub-pixels are arranged in the pattern "CBABCBABCBAB . . . " of the first mode of sub-pixel arrangement, the fifth row of sub-pixels are arranged in a pattern resulted from any combination of the two unit blocks of pattern "BAC" and "BCA" of the second mode of sub-pixel arrangement, the sixth row of sub-pixels are arranged in the pattern "CBABCBABCBAB . . . " of the first mode of sub-pixel arrangement, and so on.

Therefore, in the embodiment of the present disclosure, the sub-pixels of the same color arranged in the horizontal direction, the vertical direction and the direction along a 45 degree angle are brought closer to each other by means of such arrangements, so that the lines in various directions feel more natural for viewers and thus the picture quality is improved.

According to the embodiment of the present disclosure, and based on any arrangement described above, compensation and mapping may be further performed on the image data of individual sub-pixels, so that two sub-pixels may be used to display image data that otherwise need to be displayed by three sub-pixels, thereby improving equivalent PPI (Pixels Per Inch) without increasing the actual number of pixels.

According to the embodiment of the present disclosure, two sub-pixels may constitute a virtual pixel. As illustrated in FIG. 4, each box represents one virtual pixel. As can be seen from the drawing, in the embodiment as illustrated in FIG. 4, each virtual pixel consists of a complete sub-pixel at the center and two half sub-pixels on the left and right sides respectively. Of course, FIG. 4 only shows one way of sub-pixel arrangement, it should be understood by those of ordinary skills in the art that the present disclosure is not limited to this and there obviously are many other ways of sub-pixel arrangement.

Figure 5:
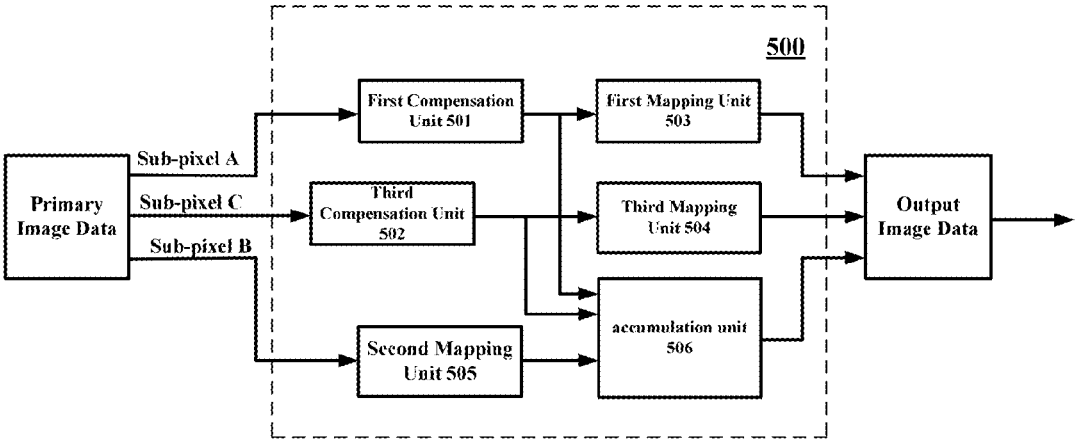
FIG. 5 is a schematic block diagram illustrating the circuitry for compensation and mapping of image data according to an embodiment of the present disclosure.

FIG. 5 is a schematic block diagram illustrating a circuitry 500 for compensation and mapping of image data according to an embodiment of the present disclosure. The circuitry illustrated in FIG. 5 may be disposed on a display panel as an integrated circuit or discrete elements together with pixels/sub-pixels, or be connected to the display panel as a peripheral circuitry.

As illustrated in FIG. 5, the circuitry 500 may include a first compensation unit 501, a third compensation unit 502, a first mapping unit 503, a second mapping unit 505, a third mapping unit 504 and an accumulation unit 506.

The first compensation unit 501 receives the primary image data DA for a sub-pixel A and uses a first compensation parameter Comp1 to perform compensation on the data DA. For example, when the sub-pixel A is located at the center of the virtual pixel it belongs to, Com1 is 100%, i.e., the result from the compensation for the sub-pixel A is DA×COMP1=DA×100%; when a sub-pixel B is located at the center of the virtual pixel that the sub-pixel A belongs to, Comp1 is m1%, i.e., the result from the compensation for the sub-pixel A is DA×Comp1=DA×m1%; when a sub-pixel C is located at the center of the virtual pixel that the sub-pixel A belongs to, Comp1 is n1%, i.e., the result from the compensation for the sub-pixel A is DA×Comp1=DA×n1%. Herein, m1 and n1 are respectively integers between 0 and 100.

The first mapping unit 503 receives the compensation result from the first compensation unit 501 and uses a first mapping parameter Map1 to perform mapping on the compensation result DA×Comp1 for the sub-pixel A. For example, when the sub-pixel A is located at the center of the virtual pixel it belongs to, Map1 is 100%, i.e., the result from the mapping for the sub-pixel A is DA×Comp1×Map1=DA×Comp1×100%, while when the sub-pixel A is not located at the center of the virtual pixel it belongs to, i.e., it is located both in the virtual pixel and in another adjacent virtual pixel, Map1=50%, that is, the result from the mapping for the sub-pixel A is DA×Comp1×Map1=DA×Comp1×50%.

The output image data for the sub-pixel A is dA=DA×Comp1×Map1.

The third compensation unit 502 receives the primary image data DC for a sub-pixel C and uses a third compensation parameter Comp3 to perform compensation on the data DC. For example, when the sub-pixel C is located at the center of the virtual pixel it belongs to, Com1 is 100%, i.e., the result from the compensation for the sub-pixel C is DC×Comp3=DC×100%; when a sub-pixel B is located at the center of the virtual pixel the sub-pixel C belongs to, Comp3 is m2%, i.e., the result from the compensation for the sub-pixel C is DC×Comp3=DC×m2%; when a sub-pixel A is located at the center of the virtual pixel the sub-pixel C belongs to, Comp3 is n2%, i.e., the result from the compensation for the sub-pixel C is DC×Comp3=DC×n2%. Herein, m2 and n2 are respectively integers between 0 and 100. Herein, m1 and n1 may be the same as or different from m2 and n2 respectively, and the specific values of m1, n1, m2, and n2 may be adjusted based on the required display effects, actual arrangement of sub-pixels or other factors.

The third mapping unit 504 receives the compensation result from the third compensation unit 502 and uses a third mapping parameter Map3 to perform mapping on the compensation result DA×Comp3 for the sub-pixel C. For example, when the sub-pixel C is located at the center of the virtual pixel it belongs to, Map3 is 100%, i.e., the result from the mapping for the sub-pixel C is DC×Comp3×Map3=DC×Comp3×100%, while when the sub-pixel C is not located at the center of the virtual pixel it belongs to, i.e., it is located both in the virtual pixel and in another adjacent virtual pixel, Map3=50%, that is, the result from the mapping for the sub-pixel C is DC×Comp3×Map3=DC×Comp3×50%.

The output image data for the sub-pixel C is dC=DC*Comp2*Map2.

The second mapping unit 505 receives the primary data for a sub-pixel B and uses a second mapping parameter Map2 to perform mapping on the primary image data for the sub-pixel B. For example, when the sub-pixel B is located at the center of the virtual pixel it belongs to, Map2 is J %, i.e., the result from the mapping for the sub-pixel B is DB×Mpa2=DB×J %, while when the sub-pixel B is not located at the center of the virtual pixel it belongs to, i.e., it is located both in the virtual pixel and in another adjacent virtual pixel, Map2=(k+i) %, that is, the result from the mapping for the sub-pixel B is DB×Map2=DB×(k+i)50%. Herein, k % represents the distance ratio between the sub-pixel B and the primary pixel, i % represents the compensation value, and J, k, and i are all integers between 0 and 100.

The accumulation unit 506 receives the compensation result DA×Comp1 for the sub-pixel A from the first compensation unit 501, the compensation result DC×Comp3 for the sub-pixel C from the third compensation unit 502 and the compensation result DB×Comp2 for the sub-pixel B from the second compensation unit 505 and superimposes them onto one another, e.g., simply adds them together, to obtain the output image data for the sub-pixel B, i.e., the output image data for the sub-pixel B is dB=DA×Comp1+DC×Comp2+DB×Map3.

It should be understood that terms "first", "second", "third" etc. are used herein to describe various elements, assemblies, areas, layers and/or parts, but the elements, assemblies, areas, layers and/or parts should not be limited by them. Those terms are only used to differentiate one element, assembly, area, layer and/or part from another element, assembly, area, layer and/or part. Therefore, a first element, assembly, area, layer and/or part referenced in the following discussion may be referred to as a second element, assembly, area, layer and/or part without departing from the teach of the present disclosure.

According to one embodiment of the present disclosure, the sub-pixel A is one of a red sub-pixel and a blue sub-pixel, the sub-pixel B is a green sub-pixel, and the sub-pixel C is the other of the red sub-pixel and the blue sub-pixel.

According to one embodiment of the present disclosure, the primary image data for the sub-pixel A, the sub-pixel B and the sub-pixel C are luminance data in the color data of their respective channels.

Furthermore, the maximum value of DA×m1%+DC×m2%+DB×J %, DA×n1%+DB×(k+i) % and DC×n2%+DB(k+i) % is the highest brightness of the sub-pixel B.

Furthermore, after the output data dA, dB and dC for the sub-pixel A, sub-pixel B and sub-pixel C are obtained, gamma correction can be applied to dA, dB and dC, so that the final gray scale values corresponding to the individual sub-pixels may be obtained through conversion using a gamma look-up table (Gamma LUT).

Therefore, according to the embodiment of the present disclosure, the image data of a pixel may be displayed by two sub-pixels on average, so that equivalent PPI may increase by 150% without increasing the actual number of sub-pixels, if compared with the conventional scheme in which the image data of a pixel are displayed by three sub-pixels.

Therefore, according to the embodiment of the present disclosure, picture quality can be improved and more display pixels (virtual pixels) can be populated into a panel of the same size through the ways of sub-pixel arrangement described above. At the same time, PPI can be increased to achieve better display effects and the problem of color fringing is resolved by using corresponding image processing algorithms.

Figure 8:
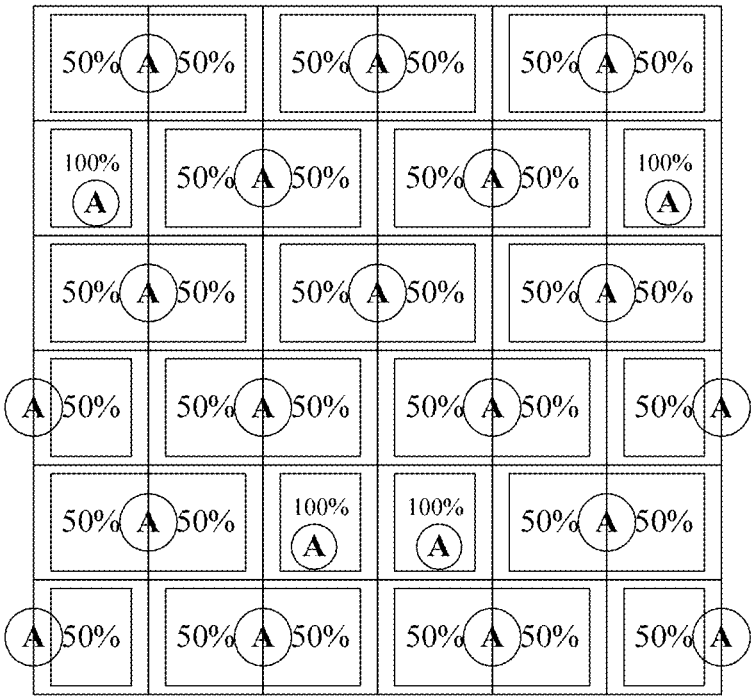
FIG. 8 is a schematic diagram illustrating the mapping effects by a first mapping unit in the case of the sub-pixel arrangement as illustrated in FIG. 4 according to an embodiment of the present disclosure.
Figure 9:
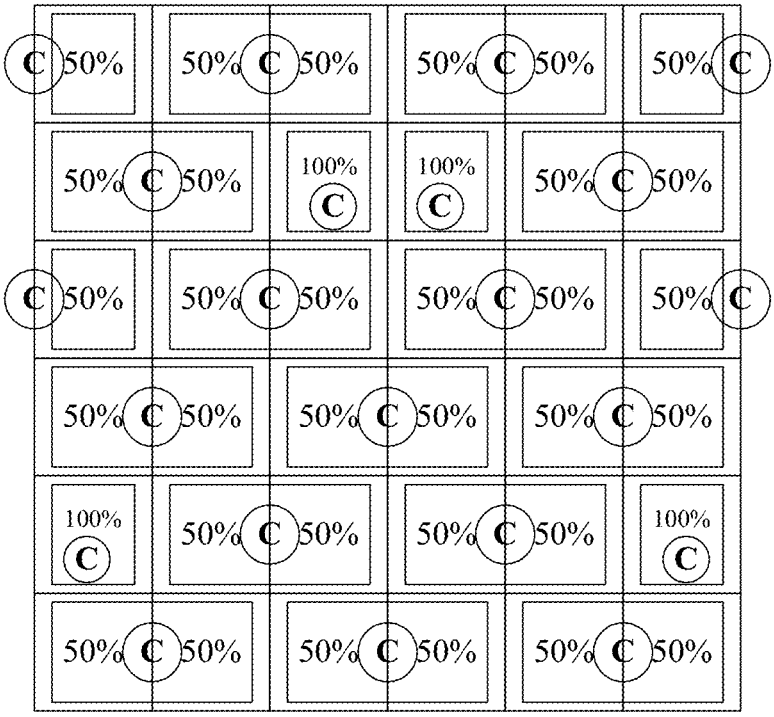
FIG. 9 is a schematic diagram illustrating the mapping effects by a second mapping unit in the case of the sub-pixel arrangement as illustrated in FIG. 4 according to an embodiment of the present disclosure.
Figure 10:
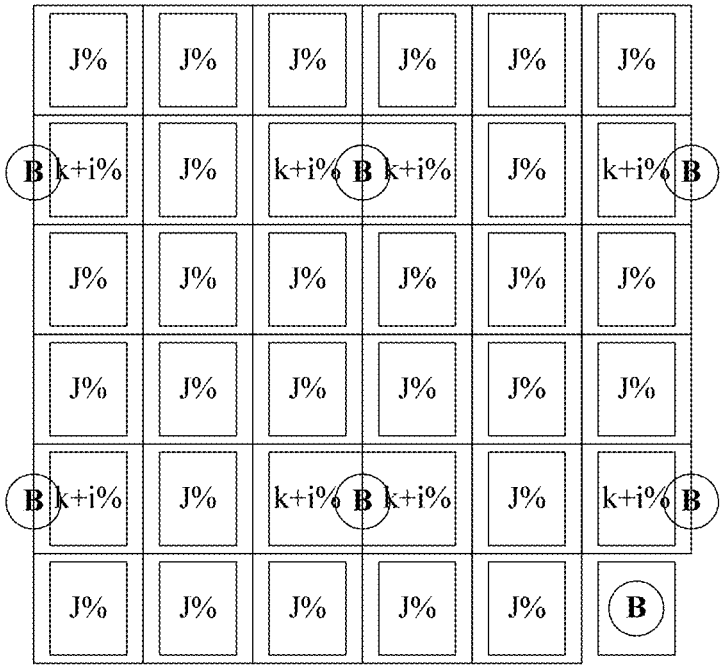
FIG. 10 is a schematic diagram illustrating the mapping effects by a third mapping unit in the case of the sub-pixel arrangement as illustrated in FIG. 4 according to an embodiment of the present disclosure.

FIG. 6 is a schematic diagram illustrating the compensation effect by the first compensation unit 501 in the case of the sub-pixel arrangement as illustrated in FIG. 4 according to an embodiment of the present disclosure, FIG. 7 is schematic diagram illustrating the compensation effect by the third compensation unit 502 in the case of the sub-pixel arrangement as illustrated in FIG. 4 according to an embodiment of the present disclosure, FIG. 8 is a schematic diagram illustrating the mapping effect by the first mapping unit 503 in the case of the sub-pixel arrangement as illustrated in FIG. 4 according to an embodiment of the present disclosure, FIG. 9 is a schematic diagram illustrating the mapping effect by the third mapping unit 504 in the case of the sub-pixel arrangement as illustrated in FIG. 4 according to an embodiment of the present disclosure, and FIG. 10 is a schematic diagram illustrating the mapping effect by the second mapping unit 505 in the case of the sub-pixel arrangement as illustrated in FIG. 4 according to an embodiment of the present disclosure.

Figure 11:
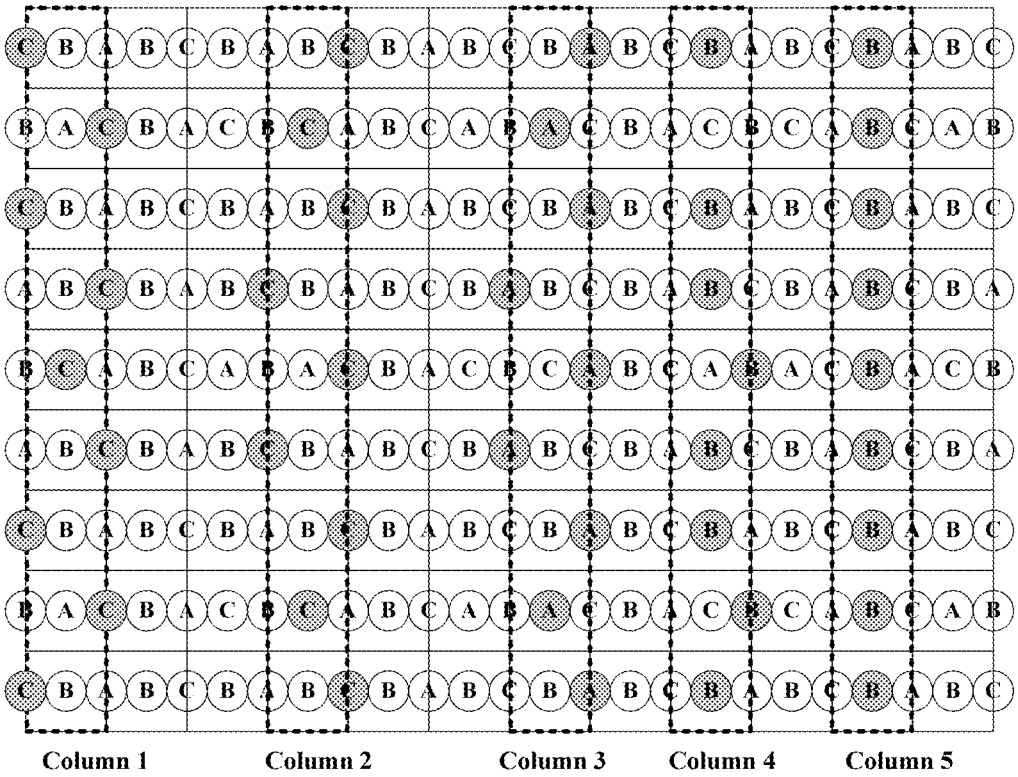
FIG. 11 is a schematic diagram illustrating the display conditions of individual sub-pixels along the column direction in the case of the sub-pixel arrangement as illustrated in FIG. 4 according to an embodiment of the present disclosure.

FIG. 11 is a schematic diagram illustrating the display conditions of the individual sub-pixels along the column direction in the case of the sub-pixel arrangement as illustrated in FIG. 4 according to an embodiment of the present disclosure.

FIG. 11 shows five (5) straight line columns, i.e., columns 1 to 5. As can be seen, with respect to sub-pixels A (red sub-pixels) and sub-pixels C (blue sub-pixels), the luminance levels of adjacent sub-pixels B (green sub-pixels) need to be adjusted by utilizing parameters m1, n1, m2 and n2 to optimize luminance centers (for columns 1, 2 and 3), so that jagged lines may be prevented from being seen by human eyes. With respect to sub-pixels B, only the condition of column 4 needs adjustment by using the parameters k and i while column 5 needs no adjustment.

Figure 12:
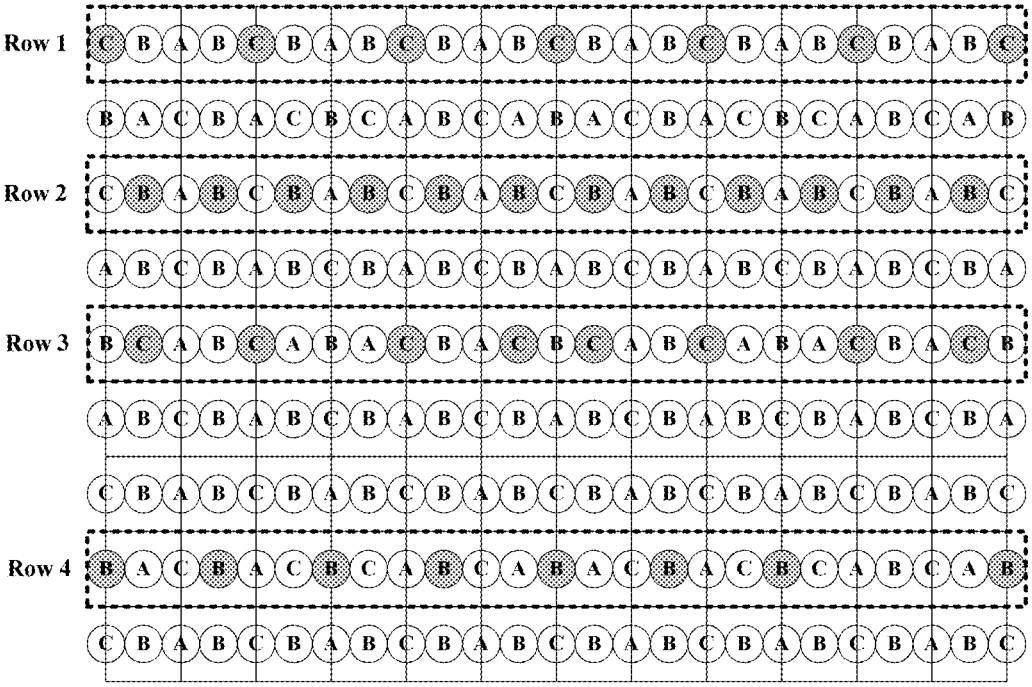
FIG. 12 is a schematic diagram illustrating the display conditions of individual sub-pixels along the row direction in the case of the sub-pixel arrangement as illustrated in FIG. 4 according to an embodiment of the present disclosure.
Figure 13A:
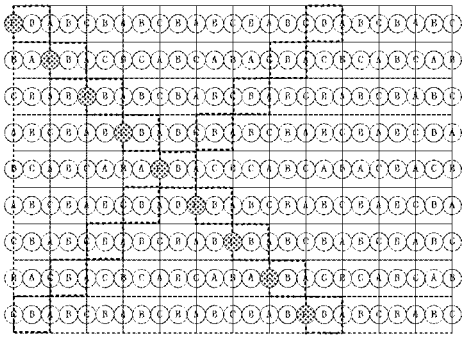
FIGS. 13(*a*) to 13(*d*) illustrate display conditions of sub-pixels C along oblique directions in the case of sub-pixel arrangement as illustrated in FIG. 4 according to an embodiment of the present disclosure.
Figure 13B:
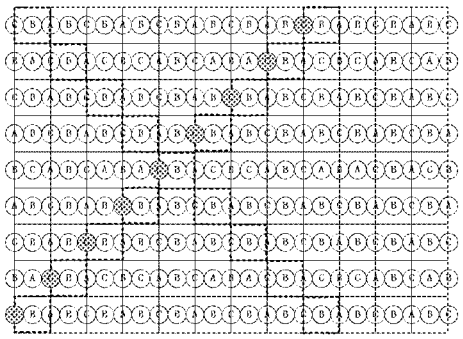
Figure 13C:
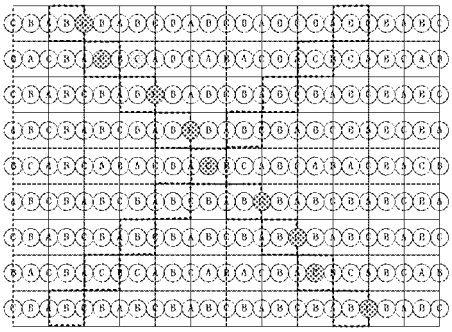
Figure 13D:
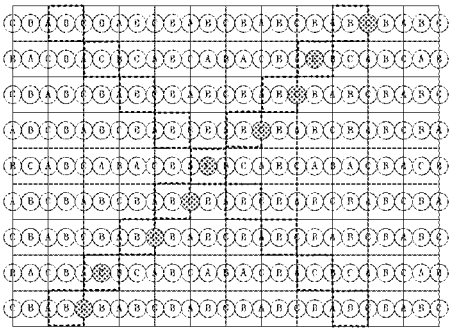

FIG. 12 is a schematic diagram illustrating the display conditions of individual sub-pixels along the row direction in the case of the sub-pixel arrangement as illustrated in FIG. 4 according to an embodiment of the present disclosure.

FIG. 12 shows four (4) straight line rows, i.e., rows 1 to 4. As can be seen, with respect to sub-pixels C (blue sub-pixels), a bit of luminance may be supplemented between sub-pixels C having a relatively longer distance therebetween utilizing a sub-pixel B (a green sub-pixel) through the process described above with reference to FIGS. 5 to 10 to make lines of sub-pixels C comparatively continuous (for rows 1 and 3) in view. The principle for lines of sub-pixels A is similar to that for lines of sub-pixels C.

Lines of sub-pixels B fall into two situations as shown in row 2 and row 4. Adjustment may be performed for sub-pixels B having a relatively longer distance therebetween by using parameters k and i to improve luminance levels of the sub-pixels B, so that the lines become continuous and consistent.

FIGS. 13(*a*) to 13(*d*) illustrate display conditions of sub-pixels C along oblique lines in the case of sub-pixel arrangement as illustrated in FIG. 4 according to an embodiment of the present disclosure, where FIG. 13(*a*) shows instance 1 of the line for sub-pixels C from upper left to lower right, FIG. 13(*b*) shows instance 1 of the line for sub-pixels C from upper right to lower left, FIG. 13(*c*) shows instance 2 of the line for sub-pixels C from upper left to lower right, and FIG. 13(*d*) shows instance 2 of the line for sub-pixels C from upper right to lower left.

Because the conditions of sub-pixels A are similar to those of sub-pixels C, the display conditions of sub-pixels A along oblique directions are omitted herein.

Figure 14A:
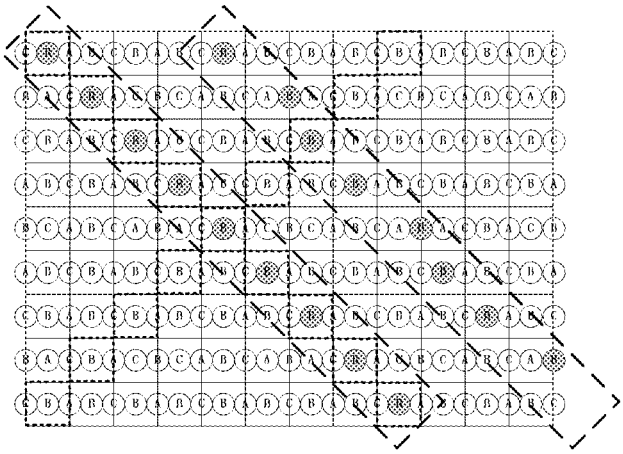
FIGS. 14(*a*) and 14(*b*) illustrate display conditions of sub-pixels B along oblique directions in the case of sub-pixel arrangement as illustrated in FIG. 4 according to an embodiment of the present disclosure.
Figure 14B:
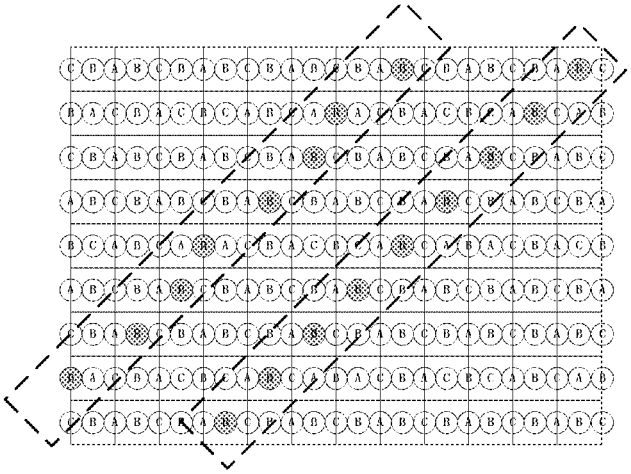

FIGS. 14(*a*) and 14(*b*) illustrate display conditions of sub-pixels B along oblique directions in the case of sub-pixel arrangement as illustrated in FIG. 4 according to an embodiment of the present disclosure, where FIG. 14(*a*) shows two instances of the line for sub-pixels B from upper left to lower right, and FIG. 14(*b*) shows two instances of the line for sub-pixels B from upper right to lower left.

It can be seen from FIGS. 13 and 14 that no color missing will occur in the row, column and oblique directions for the sub-pixel arrangement according to embodiments of the present disclosure, so that the problem of color fringing can be avoided.

According to an embodiment of the present disclosure display device including any of the display panels described above is further provided.

According to an embodiment of the present disclosure, there is further provided a method for sub-pixel arrangement, including: inserting a first sub-pixel or a third sub-pixel between every two second sub-pixels; or inserting a first sub-pixel and a third sub-pixel between every two second sub-pixels.

Therefore, in the display panel according to the embodiment of the present disclosure, sub-pixels on the display panel are arranged according to the first or second mode of sub-pixel arrangement so as to improve picture quality.

In one embodiment, inserting a first sub-pixel and a third sub-pixel between every two second sub-pixels includes arranging the sub-pixels in at least one of the sequence of a second sub-pixel, a first sub-pixel and a third sub-pixel or the sequence of a second sub-pixel, a third sub-pixel and a first sub-pixel.

In one embodiment, the first mode of sub-pixel arrangement and the second mode of sub-pixel arrangement are deployed alternately in a second direction.

In one embodiment, the first direction is one of the row direction and the column direction while the second direction is the other of the row direction and the column direction.

In one embodiment, the second sub-pixel is a green sub-pixel, the first sub-pixel is one of a red sub-pixel and a blue sub-pixel, and the third sub-pixel is the other of the red sub-pixel and the blue sub-pixel.

Therefore, according to the embodiment of the present disclosure, the image data of a pixel may be displayed by two sub-pixels on average, so that equivalent PPI increases by 150% without increasing the actual number of sub-pixels, compared with a conventional scheme in which the image data of a pixel are displayed by three sub-pixels.

Furthermore, PPI can be increased to achieve better display effects and the problem of color fringing is resolved by using corresponding image processing algorithms.

What has been described above is only specific implementation of the present disclosure, and the scope claimed by the present disclosure is not limited to this; changes and alternatives may readily occur to those of ordinary skills in the art in consideration of the technical teaching of the present disclosure, which fall within the scope claimed by the present disclosure. Therefore, the scope claimed by the present disclosure is only defined by the scope of the claims.

The application claims priority to the Chinese patent application No. 201511028542.0, filed Dec. 31, 2015, the entire disclosure of which is incorporated herein by reference as part of the present application.

What is claimed is:

1. A display panel comprising a plurality of sub-pixels arranged in an array, wherein the sub-pixels arranged in a first direction are arranged in one of following modes:

a first mode of sub-pixel arrangement, in which a first sub-pixel or a third sub-pixel is inserted between every two second sub-pixels; and a second mode of sub-pixel arrangement, in which the first sub-pixel and the third sub-pixel are inserted between every two second sub-pixels, wherein the second sub-pixel is a green sub-pixel, the first sub-pixel is one of a red sub-pixel and a blue sub-pixel, and the third sub-pixel is the other of the red sub-pixel and the blue sub-pixel, wherein compensation is performed on image data for the first sub-pixel using a first compensation parameter and mapping is performed on a compensation result of the image data for the first sub-pixel using a first mapping parameter to obtain output image data for the first sub-pixel, wherein compensation is performed on image data for the third sub-pixel using a third parameter and mapping is performed on a compensation result of the image data for the third sub-pixel using a third mapping parameter to obtain output image data for the third sub-pixel, wherein mapping is performed on image data for the second sub-pixel using a second mapping parameter, and a mapping result of the image data for the second sub-pixel, the compensation result of the image data for the first sub-pixel and the compensation result of the image data for the third sub-pixel are superimposed onto each other to obtain output image data for the second sub-pixel.

2. The display panel of claim 1, wherein, in the second mode of sub-pixel arrangement, sub-pixels are arranged in at least one of a sequence of the second sub-pixel, the first sub-pixel and the third sub-pixel and a sequence of the second sub-pixel, the third sub-pixel and the first sub-pixel.

3. The display panel of claim 1, wherein the first mode of sub-pixel arrangement and the second mode of sub-pixel arrangement are deployed alternately in a second direction.

4. The display panel of claim 3, wherein the first direction is one of a row direction and a column direction while the second direction is the other of the row direction and the column direction.

5. A display device, comprising the display panel according to claim 1.

* * * * *